US006224350B1

(12) United States Patent
Guentert et al.

(10) Patent No.: US 6,224,350 B1
(45) Date of Patent: May 1, 2001

(54) RADIAL PISTON PUMP FOR HIGH-PRESSURE FUEL DELIVERY

(75) Inventors: Josef Guentert, Gerlingen; Ralf Haegele, Weil der Stadt, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/254,655

(22) PCT Filed: Jun. 30, 1998

(86) PCT No.: PCT/DE98/01789

§ 371 Date: Jul. 29, 1999

§ 102(e) Date: Jul. 29, 1999

(87) PCT Pub. No.: WO99/02858

PCT Pub. Date: Jan. 21, 1999

(30) Foreign Application Priority Data

Jul. 11, 1997 (DE) ..... 197 29 791

(51) Int. Cl.[7] ..... F04B 1/04; F04B 39/10

(52) U.S. Cl. ..... 417/273; 417/454; 137/454.4; 137/541

(58) Field of Search ..... 417/273, 454, 417/576, 571; 137/454.4, 454.5, 515.3, 540, 541, 543.19

(56) References Cited

U.S. PATENT DOCUMENTS 255,400 * 3/1882 Waring ..... 137/541
393,980 * 12/1888 HIll ..... 137/540
990,604 * 4/1911 Stevens ..... 137/540
3,084,709 * 4/1963 Flick et al. ..... 137/515.3
4,878,815 * 11/1989 Stachowiak ..... 417/571
5,354,183 * 10/1994 Eisenbacher et al. ..... 417/273

FOREIGN PATENT DOCUMENTS

4324689 * 1/1995 (DE) .

* cited by examiner

*Primary Examiner*—Charles G. Freay
(74) *Attorney, Agent, or Firm*—Ronald E. Greigg; Edwin E. Greigg

(57) ABSTRACT

The invention relates to a radial piston pump for high-pressure fuel delivery in fuel injection systems of internal combustion engines. The pump includes a drive shaft that is supported in a pump housing and is embodied eccentrically or has a number of cam-like projections in the circumference direction, with a number of pistons that are disposed radially with regard to the drive shaft, each piston in a respective cylinder chamber. Each piston can be set into a reciprocating motion in the cylinder chamber upon rotation of the drive shaft. The pump includes an intake side and a high-pressure side check valve, and a component which has a through opening that constitutes the cylinder chamber, into whose radially outer end, a sealing element is inserted. The intake side check valve is integrated into the sealing element. In order to more compactly embody the piston pump, the sealing element is sealed in a pressure-tight fashion toward the outside in the longitudinal direction of the through opening that constitutes the cylinder chamber, and the fuel supply to the intake side check valve takes place by way of a fuel supply opening that is disposed in the component and is essentially radial to the longitudinal direction.

45 Claims, 7 Drawing Sheets

RADIAL PISTON PUMP FOR HIGH-PRESSURE FUEL DELIVERY

SPECIFICATION

The invention relates to a radial piston pump for high-pressure fuel delivery in fuel injection systems of internal combustion engines, particularly in a common rail injection system. The pump includes a drive shaft that is supported in a pump housing and is embodied as eccentric or has a number of cam-like projections in the circumference direction. A number of pistons that are disposed radially with regard to the drive shaft, each in a respective cylinder chamber, and can be set into a reciprocating motion in the cylinder chamber upon rotation of the drive shaft. An intake side check valve and a high-pressure side check valve, includes a component which has a through opening that constitutes the cylinder chamber and into whose radially outer end, a sealing element is inserted, wherein the intake side check valve is integrated into the sealing element.

A radial piston pump of this kind has been disclosed by Mannesmann Rexroth GmbH. The component that constitutes the cylinder chamber is provided inside a housing flange, i.e. is embodied as a component on the inside of the housing. The fuel supply to the intake side check valve takes place from the end of the sealing element remote from the piston, i.e. from the radial outside—with regard to the drive shaft—of the component that contains the pistons. A radially external intake chamber must therefore be provided there, which is encompassed by the housing flange.

Based on this, an object of the current invention is to disclose a more compact design of the radial piston pump.

In a radial piston pump of the type mentioned at the beginning, this object is attained according to the invention by virtue of the fact that the sealing element is sealed in a pressure-tight fashion toward the outside in the longitudinal direction of the through opening that constitutes the cylinder chamber, and the fuel supply to the intake side check valve takes place by way of a fuel supply opening that is disposed in the component and is disposed essentially radial to the longitudinal direction.

Since the sealing element constitutes a pressure-tight closure of the intake or compression unit in the longitudinal direction of the cylinder chamber or in the radial direction to the drive shaft and since the intake side fuel supply takes place transversely in relation to the longitudinal direction of the cylinder chamber through the component that defines the cylinder chamber, both the intake chamber that is on the radial outside (in relation to the drive shaft) and the additional external housing wall that is required for this can be omitted.

The sealing element can be an easy-to-install screw plug which is screwed into an internal thread that is provided on the radially outer end of the component.

It has turned out to be advantageous if the through opening in the component is embodied as offset or stepped and the sealing element is pressed with a sealing flange, in particular an annular collar-like one, in a sealed fashion against a step of the through opening and the intake valve is disposed centrally inside the sealing flange. To seal the sealing element on the radially outer end, a sealing means can be provided, for example in the form of an elastomer sealing ring, while the seal in relation to the cylinder chamber is produced by pressing the sealing flange against the step. For this purpose, it turns out to be advantageous if the sealing element can be tightened against the step like a screw plug.

In another embodiment of the invention, an annular chamber is provided opposite the sealing flange of the sealing element, between the sealing element and the wall of the component that defines the through opening, and the fuel supply opening feeds into this annular chamber. This annular chamber thus constitutes an intake chamber inside the component. The fuel supply to the component takes place by way of a metering device that is not shown.

Leading from the annular chamber, an oblique bore can be provided, which extends at a diagonal to the longitudinal direction of the through bore, into the interior of the sealing element, and to the intake side check valve, in order to produce a flow connection between the intake side of the check valve and the annular chamber.

On its end oriented toward the piston, the sealing element can have a cup-shaped recess which contains the intake side check valve.

The above-mentioned oblique bore then feeds into the cup-shaped recess. The intake side check valve, which can preferably be embodied in the manner described below, can be detached from the component that comprises the cylinder chamber and be mounted on the sealing element outside the pump housing. An element that constitutes a valve seat can be inserted in a sealed fashion into the cup-shaped recess and has a central opening through which a tappet of a valve body extends. The valve body has valve disk that is attached to the tappet and can be placed in a sealed fashion against the end face encompassing the tappet opening, i.e. against the end of the element oriented toward the piston. This brings with it the advantage that in the compression stroke of the piston, the piston end face oriented toward the sealing element can extend almost to the sealingly contacting valve disk, so that a small dead volume and thereby an optimal efficiency of the pump can be achieved.

From a technical manufacturing standpoint, it has turned out to be advantageous that the tappet can reach with play through the opening of the element that constitutes the valve seat, without this impairing the opening and closing function of the check valve.

If the valve seat and the valve body that cooperates with it have conically extending sealing faces, then the valve plate automatically centers itself when the check valve closes.

The valve is preferably embodied so that a spring which pre-stresses the valve body in the closing direction is provided on the end of the element, which is inserted into the cup-shaped recess, remote from the pump piston. The spring can be supported on one end against the element and on the other end, against a counter support that is attached to the tappet, so that the tappet is pre-stressed in the closing direction, i.e. toward the bottom of the cup-shaped recess, and is placed in a sealed fashion against the sealing seat embodied on the end of the element oriented toward the piston.

The counter support on the tappet could be embodied in an intrinsically arbitrary manner. For technical manufacturing reasons, it turns out to be particularly advantageous if the counter support is constituted by a collar bushing element, which is slid with its bushing section onto the tappet and is attached to the tappet there in a fundamentally arbitrary manner, but preferably in a positively engaging fashion, in particular by means of a crimping work cycle or a by means of a laser weld.

In another embodiment of the invention, it is quite particularly significant that the counter support is fixed to the tappet in such a position that a desired, pre-selected opening pressure of the check valve is produced. For this purpose, in the assembly of the check valve, the valve body is guided with its tappet through the tappet opening in the insertion element described above. The valve body is then placed in a sealed fashion against the sealing seat and the counter support is slid onto the tappet from the other end, with the interposition of the spring. The further the counter support is slid onto the tappet in opposition to the spring force, the greater the force that defines the opening pressure of the valve. In order to be able to predetermine a desired pressure in a lasting manner, the counter support is fixed at this position on the tappet when the desired opposing pressure is achieved.

The subassembly described above is than inserted in a sealed fashion into the cup-shaped recess of the sealing element. For this purpose, the element can be advantageously screwed into the cup-shaped recess and simultaneously glued in. A reliable and favorably sealing fixed position can be achieved in this manner. As a result of the annular chamber embodiment mentioned at the beginning, it also does not depend on a particular rotational position of the element or the subassembly with regard to the sealing element. According to another variant, the element can be introduced in a sealed fashion by means of peel riveting.

According to another variant of the invention, the valve body of the intake side check valve is provided completely inside a cup-shaped recess of the sealing element and is pre-stressed in the closing direction in a sealed fashion against the mouth region of an opening which is embodied in the bottom of the cup-shaped recess and communicates with the fuel supply. The opening mentioned can in turn, as mentioned at the beginning, communicate with an oblique bore in the sealing element and an annular chamber embodied between the sealing element and the component.

The valve body could be pre-stressed against the bottom of the cup-shaped recess in an intrinsically arbitrary manner. However, it has turned out to be constructive and advantageous for technical assembly reasons if a support for a spring that pre-stresses the valve body in the closing direction is provided at the open end of the cup-shaped recess oriented toward the pump piston and this spring is then disposed between the support and the end of the valve body oriented toward the piston. Intrinsically arbitrary radial projections could be provided in the cup-shaped recess in order to produce the support. However, with a view to a simple assembly, it has turned out to be advantageous if the support is constituted by a type of cap element with a through flow opening for the fuel to be supplied. The cap element could be provided with an internal thread and be screwed onto a corresponding flange section of the sealing element, or in lieu of a screw connection, it could be caulked to the flange section at a number of points.

According to a third variant of the invention, the sealing element includes a valve plate, which constitutes the end face of the sealing element oriented toward the piston and has a central opening through which a tappet of a valve body extends. According to this embodiment, therefore, in lieu of the element that is inserted into the cup-shaped recess, a valve plate is mounted perpendicular to the longitudinal direction of the cylinder chamber, against the end face of a sealing element base body.

The valve plate can be detachably fastened in a sealed manner against the end face of the sealing element in an intrinsically arbitrary manner; the choice of metallic seals has proven valuable for this. The valve plate is therefore preferably tightened in a pressure-tight manner against the base body of the sealing element by way of a concentrically extending biting edge. A biting edge of this kind is a type of bead-shaped metallic projection of the sealing face.

The fuel supply to the intake side of the check valve preferably takes place by virtue of the fact that at least one opening that is essentially radial to the longitudinal direction of the cylinder chamber is provided in the valve plate and communicates with the fuel supply opening in the component that constitutes the cylinder chamber.

With this embodiment, it also turns out to be advantageous if the sealing element or the sealing element base body has a cup-shaped recess into which a part of the valve body can extend, since in that case, the valve plate mentioned above can have a relatively small thickness.

The above-mentioned radial opening in the valve plate could feed into the cup-shaped recess, for example by way of an oblique bore. However, it turns out to be simpler for technical manufacturing reasons if this radial opening feeds into the tappet through opening of the valve plate on the intake side of the valve seat.

Moreover, the check valve is advantageously embodied so that the valve body has a valve disk that is attached to the tappet and can be placed in a sealed fashion against a sealing seat that encompasses the tappet opening on the end face of the valve plate.

Also according to this variant of the invention, the tappet can reach with play through the opening in the valve plate. The valve seat of the sealing plate and the valve body that cooperates with it preferably have conically extending sealing faces.

A spring that pre-stresses the valve body in the closing direction is provided on the side of the sealing plate remote from the piston. The spring is supported on one end against the valve plate and is supported on the other end against a counter support provided on the tappet. This counter support could be realized by a projection fixed to the tappet or in another arbitrary manner. It has also turned out to be particularly advantageous in this variant of the invention if the counter support is constituted by a collar bushing element which is affixed to the tappet of the valve body.

In a particularly advantageous manner, the counter support is affixed to the tappet in such a position that a desired, pre-selected opening pressure of the check valve is produced by virtue of the fact that when the valve body is resting against the sealing seat, the counter support is slid onto the tappet in opposition to the spring force until the desired opposing force that defines the opening pressure is set and the counter support is then fixed in this position on the tappet.

Other features, details, and advantages of the invention ensue from the graphic representation and subsequent description of preferred embodiments of the radial piston pump according to the invention.

DETAILED DESCRIPTION OF THE EXEMPLARY EMBODIMENTS

Figure 1:
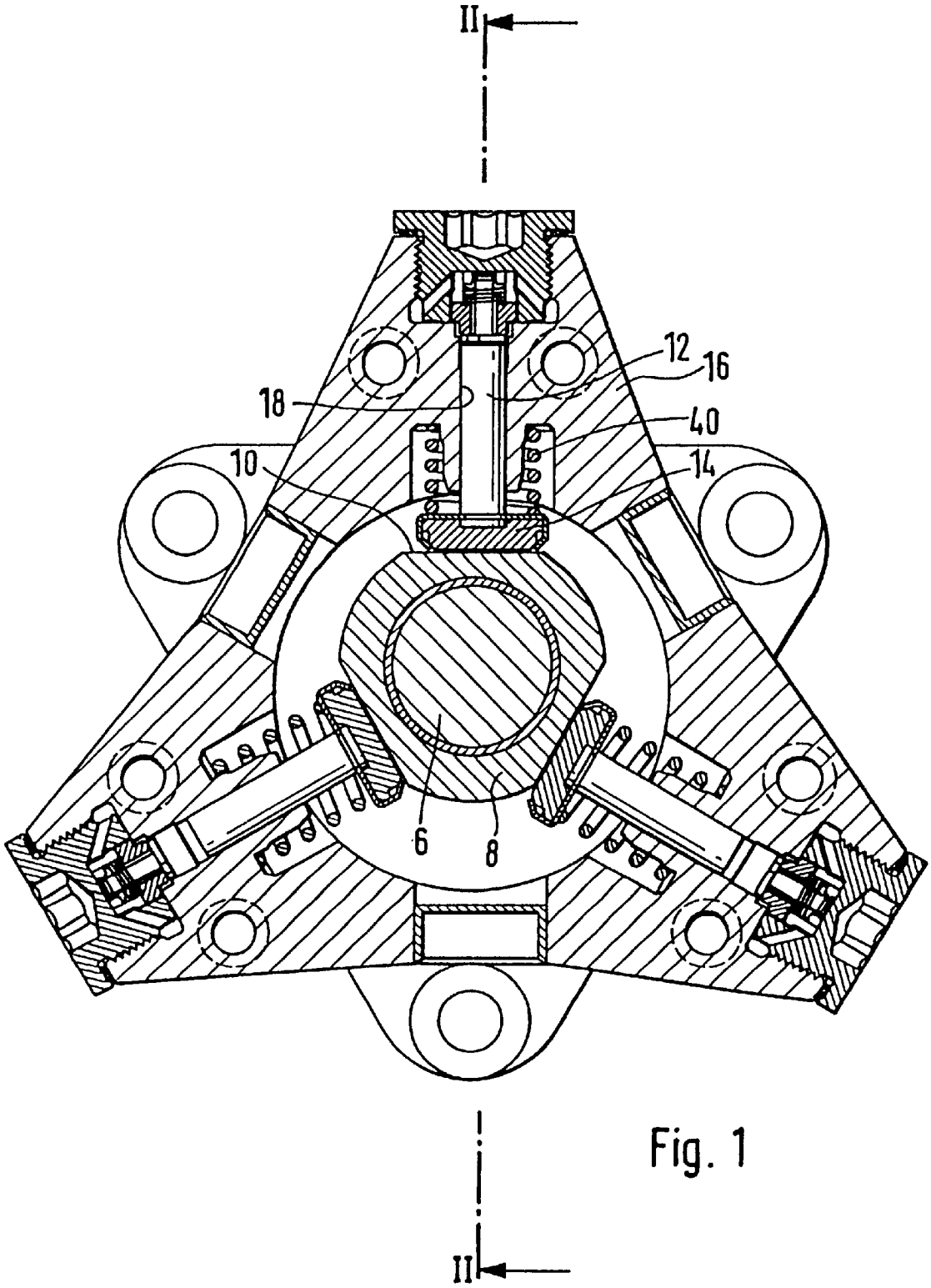
FIG. 1 is a sectional view of a first embodiment of a radial piston pump according to the invention, wherein the section runs perpendicular to the drive shaft axis.
Figure 2:
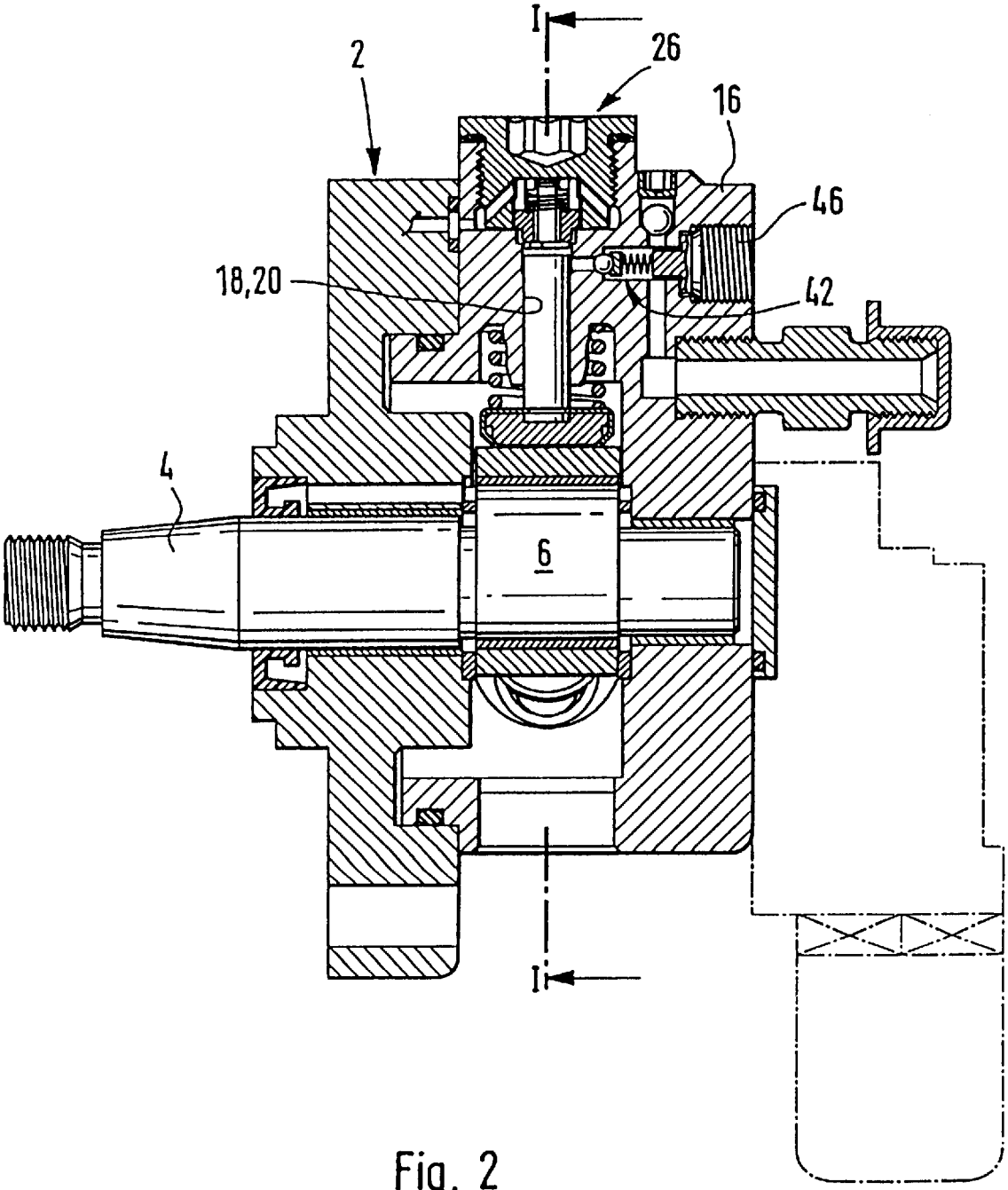
FIG. 2 is a sectional view along the plane of the arrows II—II in FIG. 1.

FIGS. 1 and 2 show a radial piston pump for high-pressure fuel delivery in fuel injection systems of internal combustion engines. The radial piston pump is designed with an integrated on-demand quantity regulation. The principle of suction throttle regulation is followed as a regulation concept. The delivery and dimensioning of fuel is carried out by way of a metering device that is not shown.

The radial piston pump includes a drive shaft 4, which is supported in a pump housing 2 and has an eccentrically embodied shaft section 6. An intermediary bushing 8 is provided on the eccentric shaft section 6 and the shaft section 6 can be rotated in relation to it. The intermediary bushing 8 includes three flattenings 10 that are offset from one another by 120°, against each of which a piston 12 is supported with a block-like contact section 14. The pistons 12 are each received so that they can move in a radial direction in relation to the drive shaft 4 in a cylinder chamber 18 that is constituted by a solid metallic component 16. In order to form the cylinder chamber 18, a through opening 20 is provided in the component 16. The through opening 20 is embodied as stepped and has a smaller diameter section 22 that constitutes the actual cylinder chamber 18 and a larger diameter section 24. A sealing element 26 is inserted in a pressure-tight manner into the radially outer end of the through opening 20, i.e. into the larger diameter section 24. The sealing element 26 is a screw plug 28 that is screwed into the larger diameter section 24 of the through opening 20 with the interposition of an O-ring seal 30.

On its end oriented toward the pump piston 12, the screw plug 28 has an annular collar-like sealing flange 30' with which the screw plug 28 is pressed in a sealed fashion against an axial stepped section 32 between the smaller diameter section 22 and the larger diameter section 24 of the through opening 20.

An intake side check valve that is labeled as a whole with the reference numeral 34 is integrated into the screw plug 28. The screw plug 28 or the check valve 34, the smaller diameter section 22 of the through opening 20 and the compressor side end face 36 of the pump piston 12 define a compressor- or high-pressure chamber 38. If the drive shaft 4 rotates 180° from the position depicted in FIG. 1, then in the meantime, the piston depicted at the top in FIG. 1 is moved out of the cylinder chamber 18 through the action of a compression spring 40. During this intake phase, the volume of the pressure chamber 38 increases and the intake side check valve 34 opens in a manner that will be described in more detail. If, after further rotation of the drive shaft 4, the piston is moved in the compression direction, then the check valve 34 is closed and a high-pressure side check valve 42 shown in FIG. 2 is opened. The high-pressure fuel in the pressure chamber 38 can then flow by way of a branch conduit 44 leading from the cylinder chamber 18, by way of the high-pressure side check valve 42, and a connection 46, to a motor piston or a high-pressure storage chamber.

Figure 3:
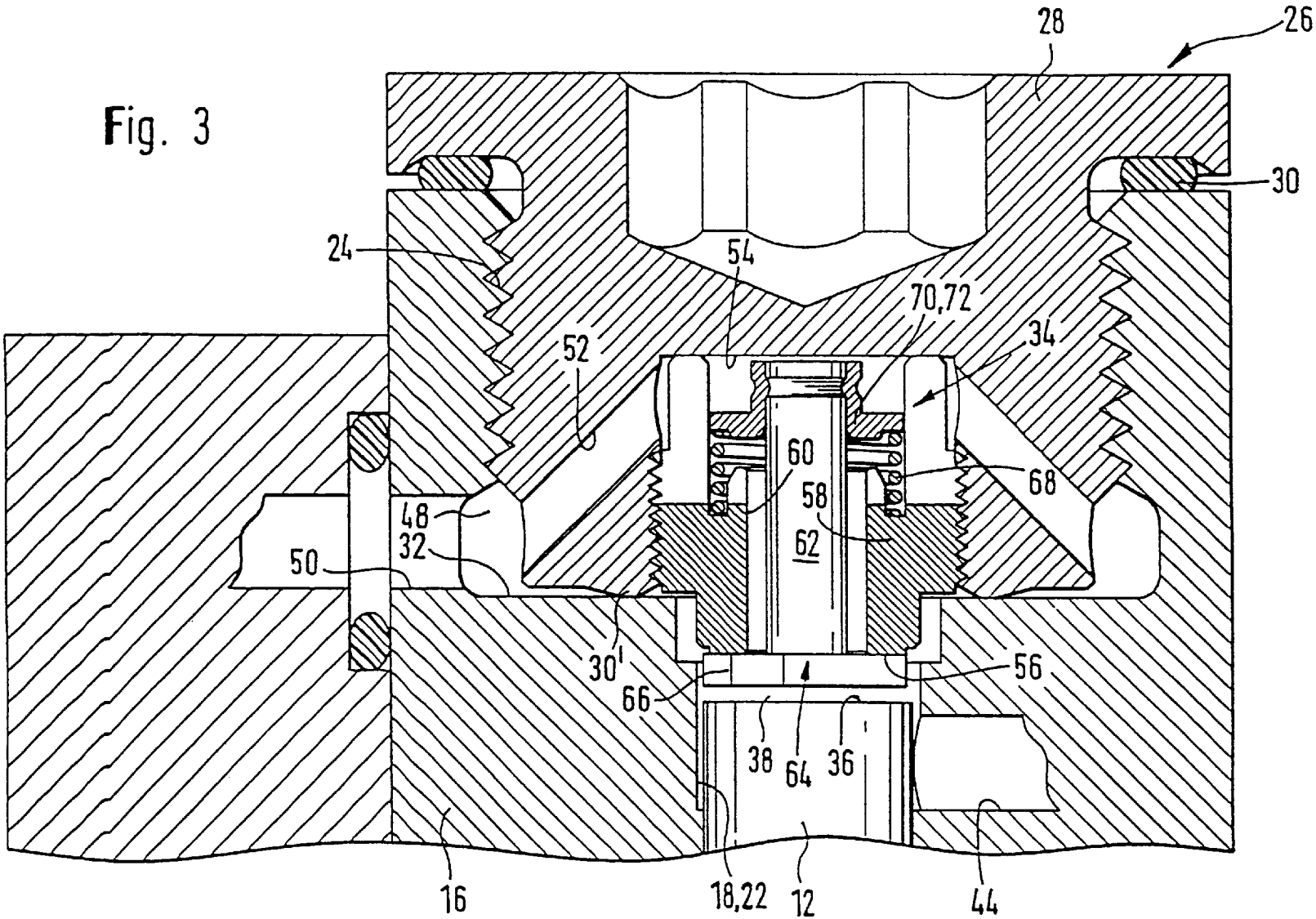
FIG. 3 is an enlarged view of a detail from FIG. 2.

As shown in detail in FIG. 3, in the region of the axial step 32 of the through opening 20, the screw plug 28 has a slightly recessed outer diameter in its radial direction and, together with the inside of the larger diameter section 24 of the through opening 20, defines an annular chamber 48. A radial fuel supply opening 50 in the component 16 feeds into this annular chamber 48. Then, a number of bores 52 that extend obliquely to the longitudinal direction of the through opening 20 lead from the annular chamber 48 and feed into a central cup-shaped recess 54 in the screw plug 28.

The intake side check valve 34 is integrated into the cup-shaped recess 54 of the screw plug 28 in the following manner: an element 58 that defines a valve seat 56 is screwed in a pressure-tight fashion with adhesive into the free end of the cup-shaped recess 54 oriented toward the piston. The element 58 has a central through opening 60 for a tappet 62 of a valve body 64. One end of the element 58 oriented toward the piston, the valve body 64 has a valve disk 66 that can be placed in a sealed fashion against the valve seat 56. On the end of the element 58 remote from the pump piston 12, inside the cup-shaped recess 54, a spring 68 is provided, which pre-stresses the tappet 62 of the valve body 64 toward the bottom of the recess 54 so that the valve disk 66 is placed in a sealed fashion against the valve seat 56. The spring 68 is supported on one end against the element 58 and on the other end, against a counter support 72 that is constituted by a collar bushing element 70. The collar bushing element 70 is crimped into the tappet 62 in such a position that a predetermined opening pressure of the check valve 34 is adjusted. The check valve 34 is mounted outside the screw plug 28 with the desired opening pressure and is then integrated into the screw plug 28 by screwing the element 58 into the cup-shaped recess 54.

Figure 4:
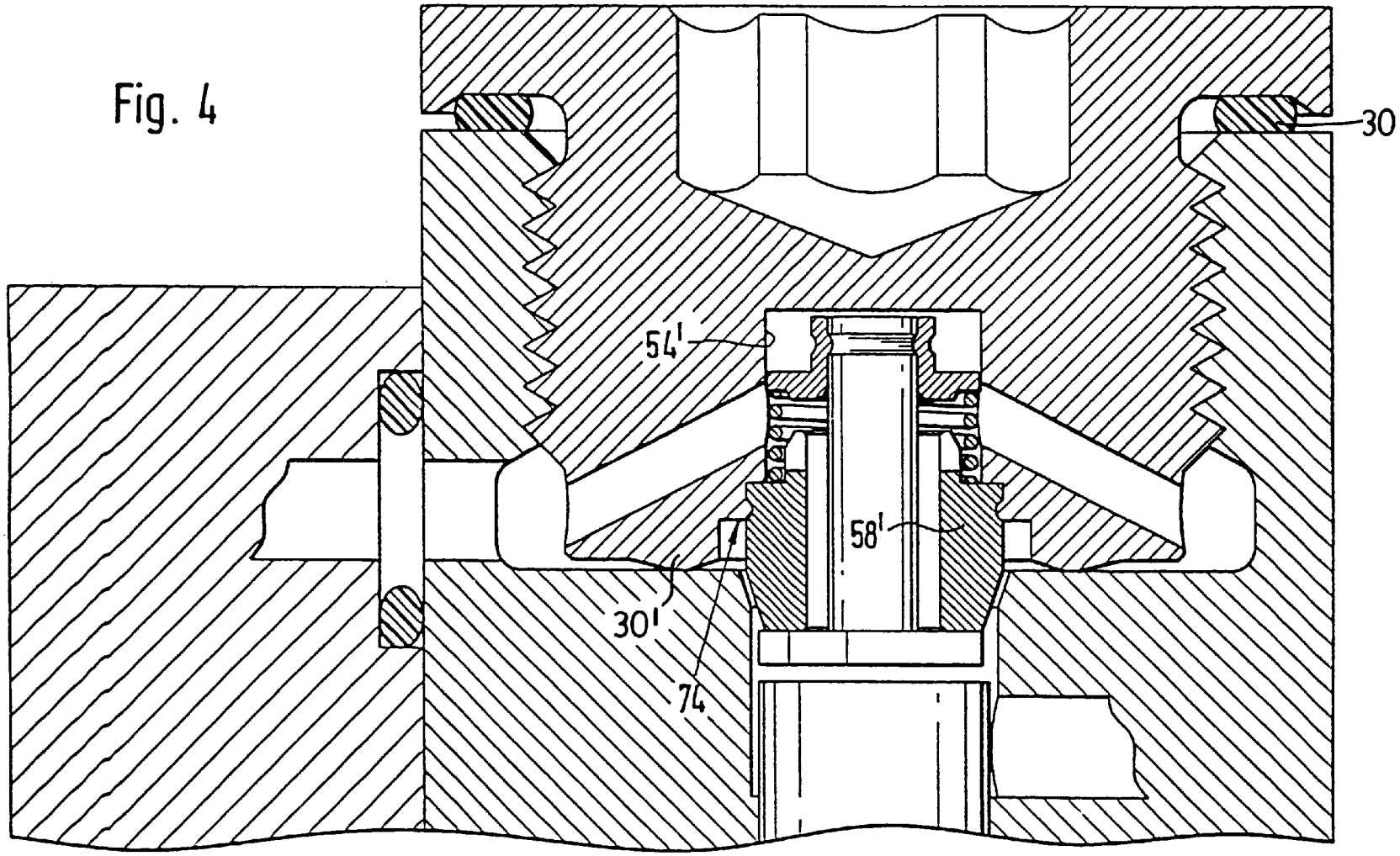
FIG. 4 is a detailed view, in accordance with FIG. 3, of a radial piston pump with a divergently embodied sealing element.

The embodiment depicted in FIG. 4 differs from that shown in FIG. 3 by virtue of the fact that the element 58' is not screwed by means of adhesive into the cup-shaped recess 54', but is non-detachably fixed by means of a peel rivet, see reference numeral 74.

Figure 5:
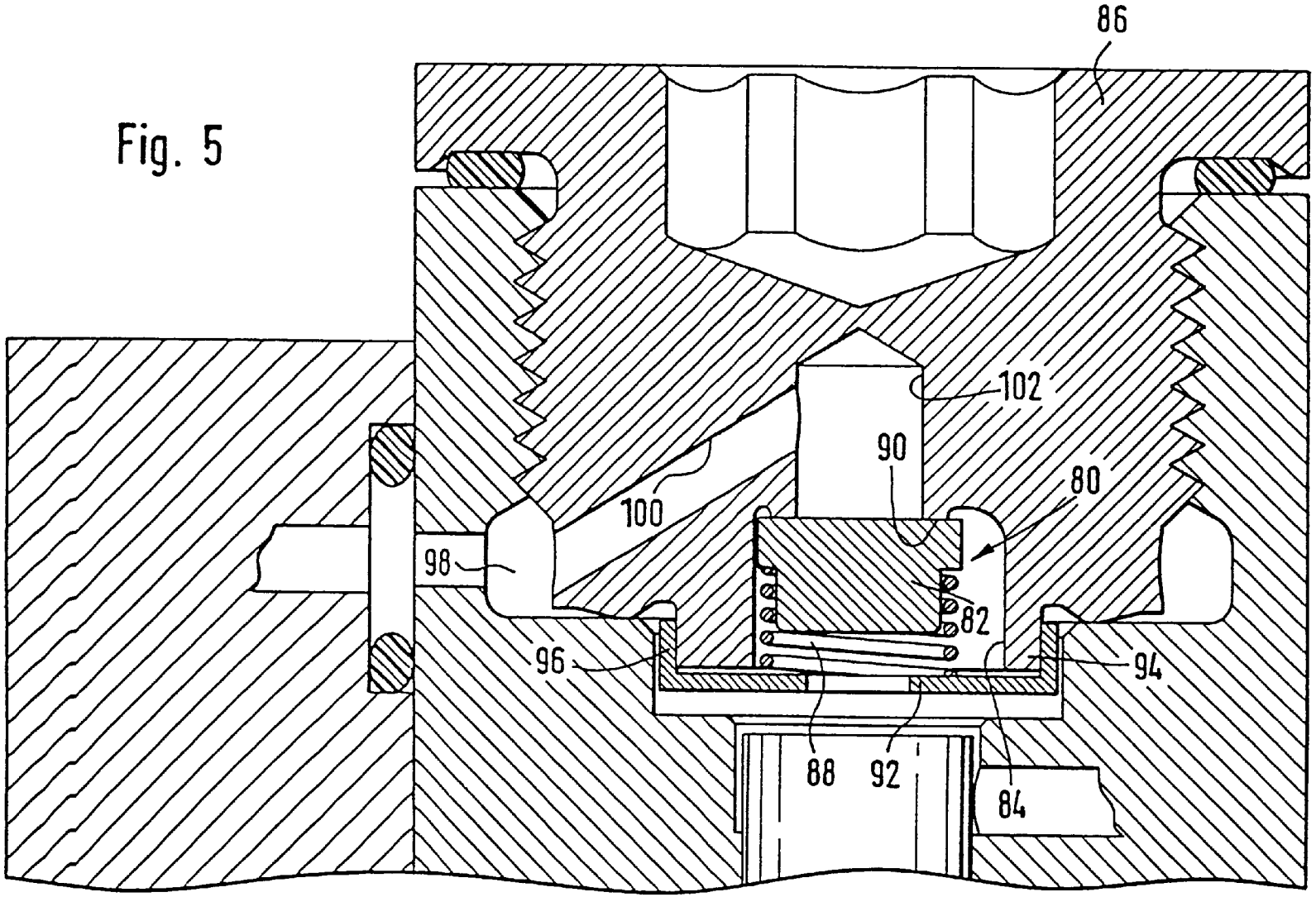
FIG. 5 is a detailed view in accordance with FIG. 3, of another embodiment of the sealing element.

In the embodiment shown in FIG. 5, the intake side check valve 80 includes a valve body 82, which is contained completely inside a cup-shaped recess 84 of the screw plug 86. The valve body 82 is pre-stressed toward the bottom 90 of the cup-shaped recess 84 by way of a spring 88, wherein the spring 88 is supported against the inside of a cap element 92, which is likewise embodied as cup-shaped in cross section, encompasses a flange section 94 of the screw plug 86, and is caulked to it at a number of points, see reference numeral 96.

From an annular chamber 98 that is also provided in this embodiment, an oblique bore 100 leads to a central blind bore 102 that is let in from the bottom 90 of the cup-shaped recess 84. When the valve body 82 is pressed against the bottom 90 of the cup-shaped recess 84 through the stress of the spring 88, then the valve body 82 completely covers the feed opening of the blind bore 102 and the check valve 80 is closed.

Figure 6:
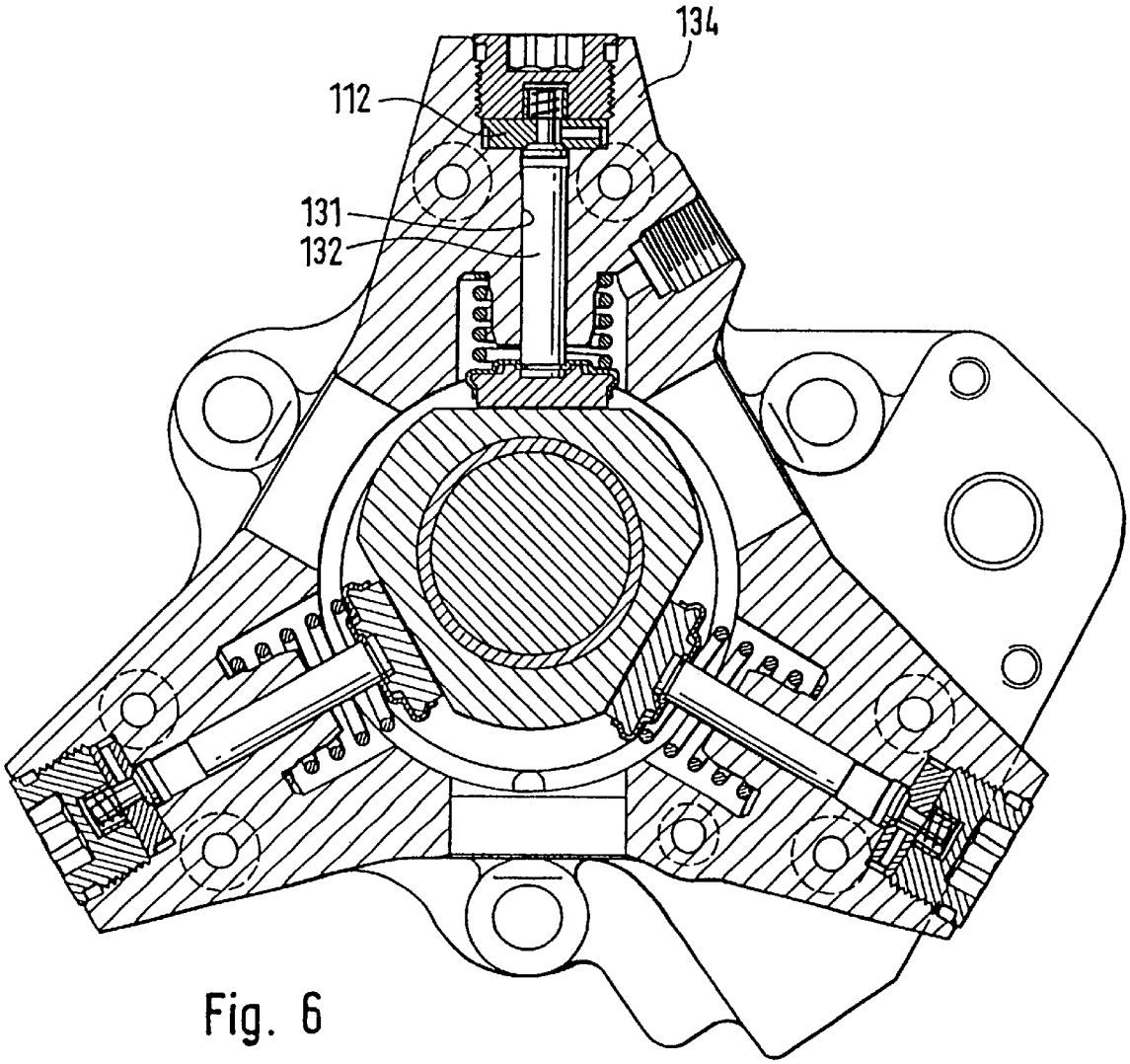
FIG. 6 is a sectional view in accordance with FIG. 1, of another embodiment of the radial piston pump according to the invention.
Figure 7:
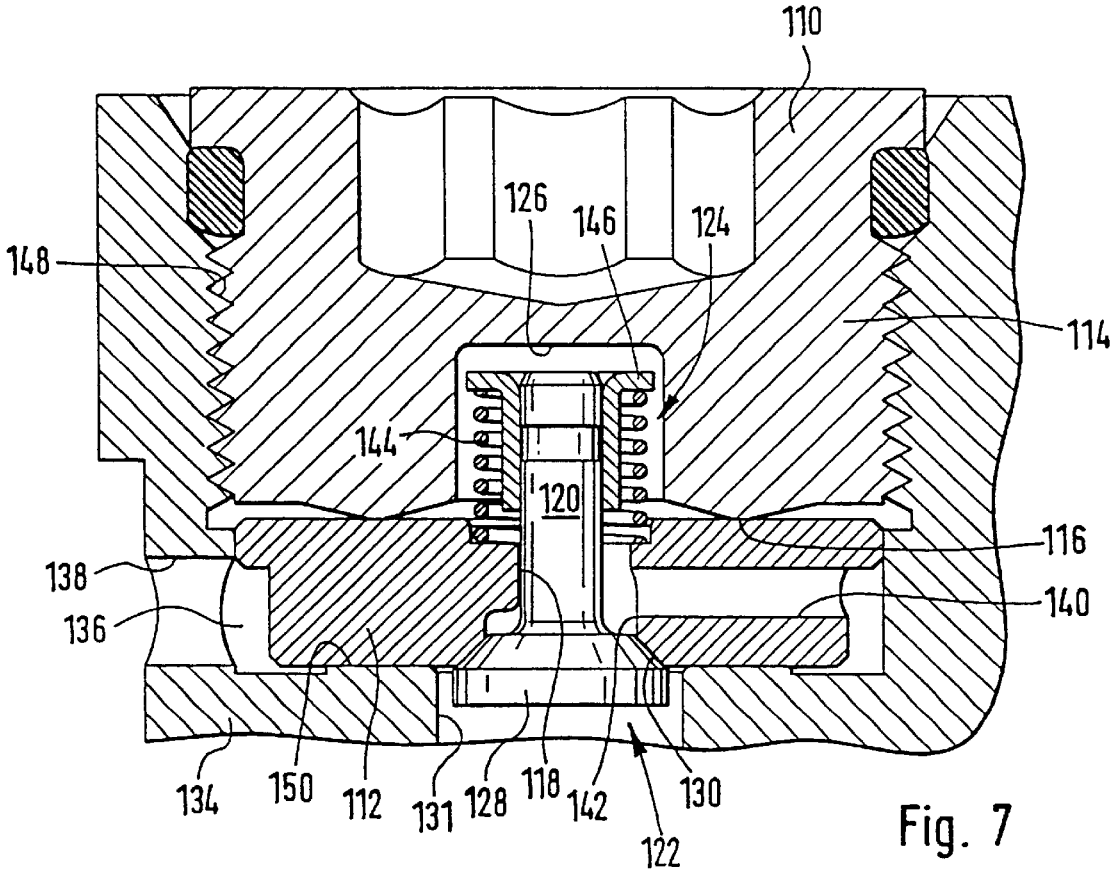
FIG. 7 is a detailed view of the sealing element according to FIG. 6.

FIGS. 6 and 7 show another embodiment of the radial piston pump according to the invention. A sealing element that is for its part embodied as a screw plug 110 includes a valve plate 112, which constitutes the end face oriented toward the piston and is tightened in a sealed fashion against a sealing element base body 114. Bead-shaped biting edges 116 are embodied for this purpose on the sealing element base body 114. The valve plate 112 includes a central opening 118 through which a tappet 120 of a valve body 122 of the intake side check valve 124 reaches. The tappet 120 reaches into a cup-shaped recess 126 in the sealing element base body 114 and on its free end oriented toward the piston, has a valve disk 128 that can be placed in a sealed fashion against a sealing seat 130 that is constituted by the valve plate 112. The valve disk 128 and sealing seat 130 have conically extending sealing faces.

On its radially outer circumference, the valve plate 112 slightly recessed and, together with the component 134 that constitutes the cylinder chamber 131 of the piston 132, defines an annular chamber 136 which communicates with the fuel supply by way of a radial fuel supply opening 138 in the component 134. A number of radial supply bores 140 in the valve plate 112 extend inward from the annular chamber 136 and feed into the tappet through opening 118 of the valve plate 112. The tappet through opening 118 is widened somewhat in the radial direction in the vicinity of the mouth, see reference numeral 142, so that when the check valve 124 is open, fuel can travel past the tappet 120 and into the compressor chamber of the pump.

In order to be able to pre-stress the valve body 122 in the closing direction, a compression spring 144 is supported inside the cup-shaped recess 126 between the inside of the valve plate 112 and a collar bushing element 146 affixed to the tappet 120.

Also with this embodiment, the check valve 124 is first mounted to the valve plate 112 outside the component 134 and the sealing element base body 114. The collar sleeve element 146 is affixed to the tappet 120 in such a position that a desired opening pressure of the check valve is produced. The unit thus pre-assembled would then be inserted and screwed into the larger diameter section 148 of the through opening in the component 134, which opening defines the cylinder chamber 131. The sealing element base body 114 is tightened in a sealed fashion against the valve disk 112 by way of the biting edges 116 and the valve disk 112 is pressed in a sealed fashion against an axial step 150 of the component 134.

The foregoing relates to a preferred exemplary embodiment of the invention, it being understood that other variants and embodiments thereof are possible within the spirit and scope of the invention, the latter being defined by the appended claims.

What is claimed is:

1. A radial piston pump for high-pressure fuel delivery in fuel injection systems of internal combustion engines including a common rail injection system, the pump includes a drive shaft (4) that is supported in a pump housing (2) and includes a portion which is eccentric in the circumference direction, a number of pistons (12, 132) are disposed radially with regard to the drive shaft (4), each piston in a respective cylinder chamber (18, 131), each piston is set into a reciprocating motion in the cylinder chamber by the eccentric portion upon rotation of the drive shaft (4), the pump includes an intake side check valve (34) and a high-pressure side check valve (42) and a housing component (16, 134) which has a through opening (20) that constitutes the cylinder chamber (18, 131), the through opening includes a smaller diameter section (22) and a larger diameter section (24) that forms a radial outer end, a sealing element (26, 110) is inserted into the radial outer end of the cylinder chamber and the intake side check valve (34) is formed in the sealing element (26, 110), the sealing element (26, 110) is sealed in a pressure-tight fashion toward an outside in a longitudinal direction of the through opening (20) that constitutes the cylinder chamber by an o-ring seal (30), and the fuel supply to the intake side check valve (34) is carried out by way of a fuel supply opening (50, 138) that is disposed in the housing component (16, 134) and is disposed essentially radial to the longitudinal direction.

2. The radial piston pump according to claim 1, in which the sealing element (26, 110) is a screw plug (28) that is screwed into an internal thread provided on the radially outer end (24) of the component (16, 134).

3. The radial piston pump according to claim 2, in which the through opening (20) is embodied as stepped which forms a step (32) and that the sealing element (26,110) includes a sealing flange (30') shaped like an annular collar, a bottom portion of the sealing element (26) is forced in a sealed fashion against the step (32, 150) of the through opening and the intake side check valve (34) is disposed centrally inside the sealing element (26).

4. The radial piston pump according to claim 1, in which the through opening (20) is embodied as stepped which forms a step (32) and that the sealing element (26, 110) includes a sealing flange (30') shaped like an annular collar, a bottom portion of the sealing element (26) is forced in a sealed fashion against the step (32, 150) of the through opening and the intake side check valve (34) is disposed centrally inside the sealing element (26).

5. The radial piston pump according to claim 4, in which an annular chamber (48, 98, 136) is provided between the sealing element (26, 86, 110) and a wall of the housing component (16, 134) which defines the larger diameter section (24) of the through opening (20), and a fuel supply opening (50, 138) in the housing component (16) feeds into the annular chamber (48).

6. The radial piston pump according to claim 5, in which leading from the annular chamber (48, 98), a blind bore (52, 100) is provided in the sealing element, the blind bore (52) extends obliquely to a longitudinal direction of the through opening (20), into the interior of the sealing element (26, 86), and to the intake side check valve (34, 80).

7. The radial piston pump according to claim 1, in which on an end oriented toward the piston (12, 132), the sealing element (26, 86, 110) has a cup-shaped recess (54, 54', 102, 126) which contains the intake side check valve (34, 80, 124).

8. The radial piston pump according to claim 7, in which a valve element (58, 58') that constitutes a valve seat (56) is inserted in a sealed fashion into the cup-shaped recess (54, 54') and the valve element has a central opening (60) through which a tappet (62) of a valve body (64) extends.

9. The radial piston pump according to claim 8, in which the valve body (64) has a valve disk (66) that is attached to the tappet (62) and is placed in a sealed fashion against the valve seat of the valve element (58, 58') that encompasses the tappet opening (60).

10. The radial piston pump according to claim 9, in which the tappet (62) extends with play through the opening (60) of the element (58, 58') that includes the valve seat (56).

11. The radial piston pump according to claim 9, in which the valve seat (56) and the valve body (64) that cooperates with the valve seat have conically extending sealing faces.

12. The radial piston pump according to claim 8, in which the tappet (62) extends with play through the opening (60) of the valve element (58, 58') that includes the valve seat (56).

13. The radial piston pump according to claim 12, in which the valve seat (56) and the valve body (64) that cooperates with the valve seat have conically extending sealing faces.

14. The radial piston pump according to claim 8, in which the valve seat (56) and the valve body (64) that cooperates with the valve seat have conically extending sealing faces.

15. The radial piston pump according to claim 7, in which on an end of the valve element (58, 58') remote from the piston (12), a spring (68) is provided, which pre-stresses the valve body (64) in a closing direction.

16. The radial piston pump according to claim 15, in which the spring (68) is supported on one end against the valve element (58, 58') and is supported on another end against a counter support (72) fastened to the target (62).

17. The radial piston pump according to claim 16 in which the counter support (72) is constituted by a collar bushing element (70).

18. The radial piston pump according to claim 17, in which the counter support (72) is attached to the tappet (62) in a positively engaging manner by a crimping work cycle.

19. The radial piston pump according to claim 17, in which the counter support (72) is affixed to the tappet (62) in such a position that a pre-selected opening pressure of the intake side check valve (34) is produced.

20. The radial piston pump according to claim 16, in which the counter support (72) is attached to the tappet (62) in a positively engaging manner by a crimping work cycle.

21. The radial piston pump according to claim 20, in which the counter support (72) is affixed to the tappet (62) in such a position that a pre-selected opening pressure of the intake side check valve (34) is produced.

22. The radial piston pump according to claim 16, in which the counter support (72) is affixed to the tappet (62) in such a position that a pre-selected opening pressure of the intake side check valve (34) is produced.

23. The radial piston pump according to claim 8, in which the valve element (58) is screwed into the cup-shaped recess (54) and glued there.

24. The radial piston pump according to claim 8, in which the valve element (58') is inserted into the cup-shaped recess (54') in a sealed fashion by means of peel riveting.

25. The radial piston pump according to claim 8, in which the valve body (82) of the intake side check valve (80) is provided in the cup-shaped recess (84) of the sealing element (86) and is pre-stressed by a spring in the closing direction in a sealed fashion against a mouth region of an opening (102) that is disposed in a bottom (90) of the cup-shaped recess (84) and communicates with the fuel supply.

26. The radial piston pump according to claim 25, in which on an open end of the cup-shaped recess (84) oriented toward the piston, a support is provided for the spring (88) that pre-stresses the valve body (82) in the closing direction.

27. The radial piston pump according to claim 26, in which the support is constituted by a cap element (92) with a through flow opening.

28. The radial piston pump according to claim 27, in which the cap element (92) is cup-shaped in cross section and engages around a flange section (94) of the sealing element (86).

29. The radial piston pump according to claim 28, in which the cap element (92) is caulked to the sealing element (86) at a number of points.

30. The radial piston pump according to claim 27, in which the cap element (92) is caulked to the sealing element (86) at a number of points.

31. The radial piston pump according to claim 1, in which the sealing element (110) includes a valve plate (112) that constitutes an end face of the sealing element, said end face is oriented toward the piston and has a valve seat (130), and said sealing element has a central opening (118) through which a tappet (120) of a valve body (122) reaches.

32. The radial piston pump according to claim 31, in which the valve plate (112) is tightened in a pressure-tight manner against a base body (114) of the sealing element (110) by a concentrically extending biting edge (116) on an end of the bore body (114).

33. The radial piston pump according to claim 32, in which at least one opening (140) that is essentially radial to the longitudinal direction of the cylinder chamber (131) is provided in the valve plate (112) and communicates with the fuel supply opening (138) in the housing component (134).

34. The radial piston pump according to claim 31, in which at least one opening (140) that is essentially radial to the longitudinal direction of the cylinder chamber (131) is provided in the valve plate (112) and communicates with the fuel supply opening (138) in the housing component (134).

35. The radial piston pump according to claim 34, in which the radial opening (140) feeds into the tappet through opening (118) of the valve plate (112).

36. The radial piston pump according to claim 31, in which on an end oriented toward the piston (132), the base body (114) of the sealing element (110) has a cup-shaped recess (126) into which the tappet (120) of the check valve (124) protrudes.

37. The radial piston pump according to claim 36, in which the valve body (122) has a valve disk (128) that is attached to the tappet (120) and can be placed in a sealed fashion against a sealing seat (130), which encompasses the tappet opening (118) and is disposed on an end face of the valve plate (112).

38. The radial piston pump according to claim 36, in which the tappet (120) extends with play through the opening (118) in the valve plate (112).

39. The radial piston pump according to claim 38, in which the valve seat (130) of the valve plate (112) and the valve body (122) that cooperates with the valve seat have conically extending sealing faces.

40. The radial piston pump according to claim 36, in which a spring (144) which pre-stresses the valve body (122) in the closing direction is provided on a side of the valve plate (112) remote from the piston (132).

41. The radial piston pump according to claim 40, in which the spring (144) is supported on one end against the valve plate (112) and is supported on another end against a counter support that is provided on the tappet (120).

42. The radial piston pump according to claim 41, in which the counter support is constituted by a collar bushing element (146).

43. The radial piston pump according to claim 42, in which the counter support is attached to the tappet (122) in a positively engaging manner, by a crimping work cycle.

44. The radial piston pump according to claim 41, in which the counter support is attached to the tappet (122) in a positively engaging manner, by a crimping work cycle.

45. The radial piston pump according to claim 41, in which the counter support is affixed to the tappet (122) in such a position that a pre-selected opening pressure of the check valve (124) is produced.

* * * * *